US006789623B2

(12) United States Patent
Hill, Jr. et al.

(10) Patent No.: US 6,789,623 B2
(45) **Date of Patent: *Sep. 14, 2004**

(54) METHOD AND APPARATUS FOR OPEN HOLE GRAVEL PACKING

(75) Inventors: Leo E. Hill, Jr., Huffman, TX (US); Christian F. Bayne, The Woodlands, TX (US)

(73) Assignee: Baker Hughes Incorporated, Houston, TX (US)

( * ) Notice: Subject to any disclaimer, the term of this patent is extended or adjusted under 35 U.S.C. 154(b) by 0 days.

This patent is subject to a terminal disclaimer.

(21) Appl. No.: 10/102,983

(22) Filed: Mar. 21, 2002

(65) Prior Publication Data

US 2002/0195253 A1 Dec. 26, 2002

Related U.S. Application Data

(63) Continuation-in-part of application No. 09/550,439, filed on Apr. 17, 2000, now Pat. No. 6,382,319, which is a continuation-in-part of application No. 09/359,245, filed on Jul. 22, 1999, now Pat. No. 6,230,801.

(60) Provisional application No. 60/093,714, filed on Jul. 22, 1998.

(51) Int. Cl.[7] ..... E21B 33/12; E21B 33/122; E21B 43/04; E21B 43/110

(52) U.S. Cl. ..... 166/278; 166/51; 166/181; 166/194; 166/332.8; 166/377; 166/380; 166/382; 166/387

(58) Field of Search ..... 166/51, 181, 191, 166/278, 332.8, 374, 377, 380, 382, 386, 387

(56) References Cited

U.S. PATENT DOCUMENTS

| | | | | |
|---|---|---|---|---|
| 3,952,804 A | | 4/1976 | Smyrl | 166/278 |
| 4,295,524 A | * | 10/1981 | Baker et al. | 166/278 |
| 4,522,264 A | | 6/1985 | McNeer | 166/278 |

(List continued on next page.)

FOREIGN PATENT DOCUMENTS

WO WO 00/05484 2/2000

OTHER PUBLICATIONS

Porter, Hollis P., Petroleum Dictionary for Office, Field and Factory, 1948, The Gulf Publishing Company, Fourth Edition, p. 131.*

Tver, David F., The Petroleum Dictionary, 1980, Van Nostrand Reinhold Company Inc., p. 168.*

Duhon et al., Halliburton Energy Services, ANew Completion Techniques Applied to a Deepwater Gulf of Mexico TLP Completion Successfully Gravel Pack an Openhole Horizontal Interval of 2400 Feet,@ XP–002120001, OTC Proceedings, 1998 Offshore Technology Conference (13 pages).

*Primary Examiner*—George Suchfield
(74) *Attorney, Agent, or Firm*—Madan, Mossman & Sriram, P.C.

(57) ABSTRACT

The apparatus includes a gravel pack assembly comprising a gravel pack body and a crossover tool. The gravel pack body comprises a pressure set packer, one or more production screens and a plurality of axial position indexing lugs. The crossover tool comprises auxiliary flow chambers, packer by-pass channels, a crossover tool check valve and an axial position indexing collet. The gravel pack body and crossover tool are assembled coaxially as a cooperative unit by a threaded joint and the unit is threadably attached to the bottom end of a tool string for selective placement within the wellbore. Set of the packer secures the gravel pack body to the well casing and seals the casing annulus around the gravel pack assembly. A positive fluid pressure is maintained on the wellbore wall in the production zone throughout the gravel packing procedure and in particular, during the packer seal test interval when fluid pressure that is egual to or greater than the normal hydrostatic pressure is maintained on the production zone wall under the gravel pack body packer while greater test pressure above the hydrostatic is imposed in the wellbore annulus above the packer.

16 Claims, 8 Drawing Sheets

U.S. PATENT DOCUMENTS

| | | | | | |
|---|---|---|---|---|---|
| 4,700,777 | A | | 10/1987 | Luers | 166/51 X |
| 4,915,172 | A | | 4/1990 | Donovan et al. | 166/278 |
| 5,069,280 | A | | 12/1991 | McKee et al. | 166/278 |
| 5,332,038 | A | * | 7/1994 | Tapp et al. | 166/278 |
| 5,333,688 | A | | 8/1994 | Jones et al. | 166/278 |
| 5,373,899 | A | | 12/1994 | Dore et al. | 166/278 |
| 5,505,260 | A | | 4/1996 | Andersen et al. | 166/278 |
| 5,676,208 | A | | 10/1997 | Finley | 166/278 |
| 5,875,852 | A | | 3/1999 | Floyd et al. | 166/191 X |
| 5,931,229 | A | | 8/1999 | Lehr et al. | 166/278 |
| 5,971,070 | A | | 10/1999 | Ross et al. | 166/278 |
| 6,095,245 | A | | 8/2000 | Mount | 166/278 |
| 6,230,801 | B1 | | 5/2001 | Hill, Jr. et al. | 166/278 |
| 6,382,319 | B1 | | 5/2002 | Hill, Jr. et al. | 166/278 |

* cited by examiner

METHOD AND APPARATUS FOR OPEN HOLE GRAVEL PACKING

CROSS-REFERENCE TO RELATED APPLICATIONS

This application is a continuation-in-part of U.S. patent application Ser. No. 09/550,439 that was filed on Apr. 17, 2000 now U.S. Pat. No. 6,382,319 and is hereby incorporated herein by reference in its entirety. Pending U.S. patent application Ser. No. 09/550,439 is a continuation-in-part application of U.S. patent application Ser. No. 09/359,245 that was filed on Jul. 22, 1999 and issued May 15, 2001 as U.S. Pat. No. 6,230,801 and is hereby incorporated herein by reference in its entirety. U.S. Pat. No. 6,230,801 is related to and claims priority from U.S. Provisional Application Serial No. 60/093,714, filed on Jul. 22, 1998, which is hereby incorporated by reference in its entirety.

BACKGROUND OF THE INVENTION

This invention generally relates to a method of hydrocarbon well completion and the associated apparatus for practicing the method. More particularly, the invention provides an open hole gravel packing system wherein a positive hydrostatic pressure differential within the well borehole is maintained against the production formation walls throughout all phases of the gravel packing procedure.

DESCRIPTION OF THE PRIOR ART

To extract hydrocarbons such as natural gas and crude oil from the earth's subsurface formations, boreholes are drilled into hydrocarbon bearing production zones. To maintain the productivity of a borehole and control the flow of hydrocarbon fluids from the borehole, numerous prior art devices and systems have been employed to prevent the natural forces from collapsing the borehole and obstructing or terminating fluid flow therefrom. One such prior art system provides a full depth casement of the wellbore whereby the wellbore wall is lined with a steel casing pipe that is secured to the bore wall by an annulus of concrete between the outside surface of the casing pipe and the wellbore wall. The steel casing pipe and surrounding concrete annulus is thereafter perforated by ballistic or pyrotechnic devices along the production zone to allow the desired hydrocarbon fluids to flow from the producing formation into the casing pipe interior. Usually, the casing interior is sealed above and below the producing zone whereby a smaller diameter production pipe penetrates the upper seal to provide the hydrocarbon fluids a smooth and clean flowing conduit to the surface.

Another prior art well completion system protects the well borewall production integrity by a tightly packed deposit of aggregate comprising sand, gravel or both between the raw borewall and the production pipe thereby avoiding the time and expense of setting a steel casing from the surface to the production zone which may be many thousands of feet below the surface. The gravel packing is inherently permeable to the desired hydrocarbon fluid and provides structural reinforcement to the bore wall against an interior collapse or flow degradation. Such well completion systems are called "open hole" completions. The apparatus and process by which a packed deposit of gravel is placed between the borehole wall and the production pipe is encompassed within the definition of an "open hole gravel pack system." Unfortunately, prior art open hole gravel pack systems for placing and packing gravel along a hydrocarbon production zone have been attended by a considerable risk of precipitating a borehole wall collapse due to fluctuations in the borehole pressure along the production zone. These pressure fluctuations are generated by surface manipulations of the downhole tools that are in direct fluid circulation within the well and completion string.

Open hole well completions usually include one or more screens between the packed gravel annulus and a hydrocarbon production pipe. The term "screen" as used herein may also include slotted or perforated pipe. If the production zone is not at the bottom terminus of the well, the wellbore is closed by a packer at the distal or bottom end of the production zone to provide bottom end support for the gravel pack volume. The upper end of the production zone volume is delineated by a packer around the annulus between the wellbore and the pipe column, called a "completion string", that carries the hydrocarbon production to the surface. This upper end packer may also be positioned between the completion string and the inside surface of the well casing at a point substantially above the screens and production zone.

Placement of these packers and other "downhole" well conditioning equipment employs a surface controlled column of pipe that is often characterized as a "tool string". With respect to placement of a gravel pack, a surface controlled mechanism is incorporated within the tool string that selectively directs a fluidized slurry flow of sand and/or gravel from within the internal pipe bore of the tool string into the lower annulus between the raw wall of the wellbore and the outer perimeter of the completion string. This mechanism is positioned along the well depth proximate of the upper packer. As the mechanism directs descending slurry flow from the tool string bore into the wellbore annulus, it simultaneously directs the rising flow of slurry filtrate that has passed through screens in a production pipe extended below the upper packer. This rising flow of slurry filtrate is directed from the production pipe bore into the wellbore annulus above the upper packer.

It is during the interval of manually manipulated change in the slurry flow direction that potential exists for creating a hydrostatic pressure environment within the wellbore annulus below the upper packer that is less than the natural hydrostatic pressure of fluid within the formation. Such a pressure imbalance, even briefly, may collapse the borehole or otherwise damage the productivity of the production zone borehole wall or damage the filter cake. Highly deviated or horizontal production zone boreholes are particularly susceptible to damage due to such a pressure imbalance. Consequently, it is an object of the present invention to provide a flow cross-over mechanism that will provide a positive (overburden) pressure against a borehole wall throughout all phases of the gravel packing process.

It is also an object of the invention to provide a procedure and mechanism for maintaining fluid pressure on the production zone wellbore wall below the upper packer that is at least equal or greater than the natural hydrostatic pressure after the packer is set and while a greater fluid pressure is imposed on the wellbore annulus above the upper packer for testing the seal integrity of the packer.

Another object of the present invention to provide an apparatus design that facilitates a substantially uniform overburden pressure within a borehole production zone throughout the cross-flow changes occurring during a gravel packing procedure.

SUMMARY OF THE INVENTION

A preferred embodiment of the present invention includes a gravel pack extension tube that is permanently secured within a wellbore casing; preferably in or near the well production zone thereof. Near the upper end of the gravel pack extension tube is a packing seal that obstructs fluid flow through an annular section of the casing between the internal casing wall and the external perimeter of the gravel pack extension tube. The lower end of the gravel pack extension tube includes an open bore pipe that may be extended below the casing bottom and along the open borehole into the production zone. The distal end of the lower end pipe is preferably closed with a bull plug. Along the lower end of the pipe extension, within the hydrocarbon production zone and above the bull plug, are one or more gravel screens that are sized to pass the formation fluids while excluding the formation debris.

Internally, the upper end of the gravel pack extension tube provides two, axially separated, circular seal surfaces having an annular space therebetween. Further along the gravel pack extension tube length, several, three for example, axially separated, axial indexing lugs are provided to project into the extension tube bore space as operator indicators.

The dynamic or operative element of the present packing apparatus is a crossover flow tool that is attached to the lower end of a tool string. Concentric axial flow channels around the inner bore channel are formed in the upper end of the upper end of the crossover flow tool. An axial indexing collet is secured to the crossover tool assembly in the axial proximity of the indexing lugs respective to the extension tube. A ball check valve rectifies the direction of fluid flow along the inner bore of the crossover flow tool. A plurality of transverse fluid flow ports penetrate through the outer tube wall into the concentric flow channels. Axial positionment of the crossover flow tool relative to the inner seals on the gravel pack extension seals controls the direction of fluid flow within the concentrically outer flow channels. At all times and states of flow direction within the gravel packing procedure and interval, the production zone bore wall is subjected to at least the fluid pressure head standing in the wellbore above the production zone by means of the transverse flow channels and the concentric outer flow channels.

BRIEF DESCRIPTION OF THE DRAWINGS

For a thorough understanding of the present invention, reference is made to the following detailed description of the preferred embodiment, taken in conjunction with the accompanying drawings, in which like elements have been given like reference characters throughout the several figures of the drawings.

DETAILED DESCRIPTION OF THE PREFERRED EMBODIMENTS

Figure 1:
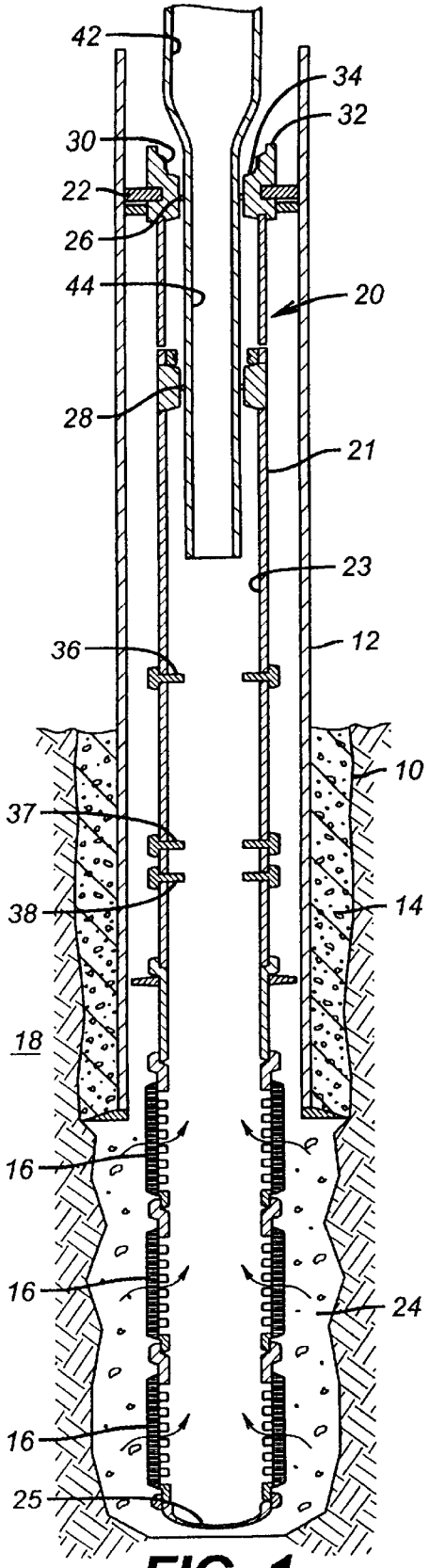
FIG. 1 is a sectional elevation of a completed oil well borehole having the present invention gravel pack extension secured therein.

The sectional elevation of FIG. 1 illustrates a hydrocarbon producing well having an upper casing 12. The well casing 12 is preferably secured to the wall 10 of the wellbore by an annular concrete jacket 14. Near the lower end of the casing 12, within the internal bore of the casing, a gravel pack body 20 is secured by slips and a pressure seal packer 22. Generally, the gravel pack body is an open flowpipe 21 having one or more cylindrical screen elements 16 near the lower end thereof. The flowpipe lower end projects into the hydrocarbon bearing production zone 18. In the annular space between the wellbore wall 10 and the screen elements 16 is a tightly consolidated deposit 24 of aggregate such as sand and gravel, for example. This deposit of aggregate is generally characterized in the art as a "gravel pack". Although tightly consolidated, the gravel pack is highly permeable to the hydrocarbon fluids desired from the formation production zone. Preferably, the gravel pack 24 surrounds all of the screen 16 flow transfer surface and extends along the borehole length substantially coextensively with the hydrocarbon fluid production zone. The flowpipe lower end is terminated by a bull plug 25, for example.

Component Description

The upper end of the gravel pack body 20 comprises a pair of internal pipe sealing surfaces 26 and 28 which are short lengths of substantially smooth bore, internal pipe wall having a reduced diameter. These internal sealing surfaces 26 and are separated axially by a discreet distance to be subsequently described with respect to the crossover tool 50.

The upper end of the gravel pack body 20 also integrates a tool joint thread 30, a tool shoulder 32 and a limit ledge 34. Below the pipe sealing surfaces 26 and 28 along the length of the gravel pack extension tube 23 are three collet shifting profiles 36, 37 and 38. The axial separation dimensions between the pipe sealing surfaces 26 and 28 are also critically related to the axial separation distances between collet shifting ledges 36, 37 and 38 as will be developed more thoroughly with regard to the crossover tool 50.

Hydrocarbon production fluid flow, therefore, originates from the production zone 18, passes through the gravel pack 24 and screens 16 into the internal void volume of the flowpipe 21. From the screens 16, the fluid enters and passes through the terminal sub 44 and into the production pipe 42. The production pipe 42 carries the fluid to the surface where it is appropriately channeled into a field gathering system.

The aggregate constituency of the gravel pack 24 is deposited in the wellbore annulus as a fluidized slurry. Procedurally, the slurry is pumped down the internal pipe bore of a completion string that is mechanically manipulated from the surface. Generally, completion string control movement includes only rotation, pulling and, by gravity, pushing. Consequently, with these control motions the slurry flow must be transferred from within the completion string bore into the annulus between the wellbore wall and the gravel pack extension flow pipe 21 above the screens 16. The screens 16 separate the fluid carrier medium (water, for example) from the slurry aggregate as the carrier medium enters the internal bore of the flow pipe 21. The flow pipe channels the carrier medium return flow up to a crossover point within the completion string where the return flow is channeled into the annulus between the internal casing walls 12 and the outer wall surfaces of the completion string. From the crossover point, the carrier medium flow is channeled along the casing annulus to the surface.

Figure 2:
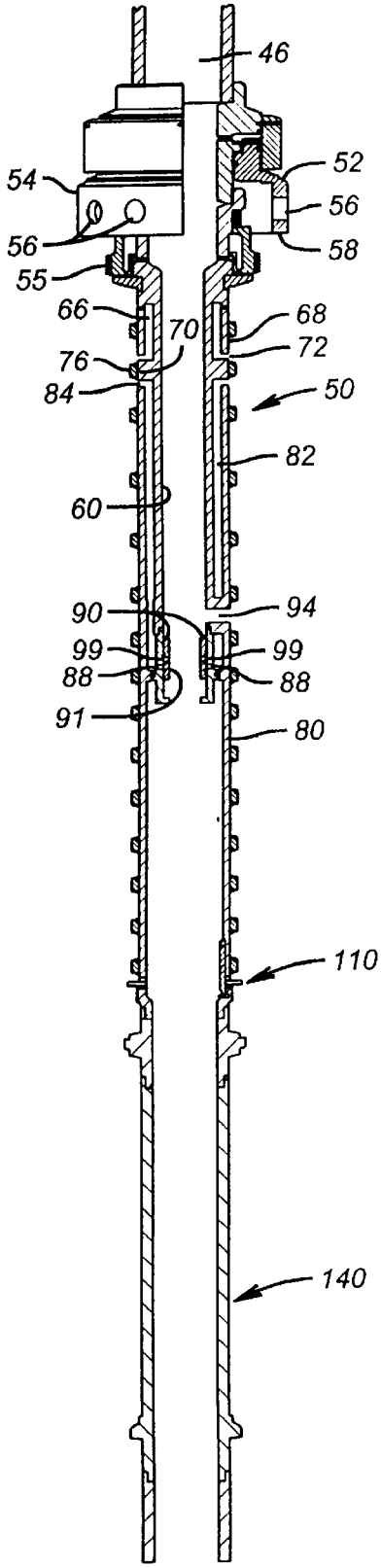
FIG. 2 is a sectional elevation of the present invention crossover tool.

When the desired quantity of gravel pack is in place, the internal bore of the completion string must be flushed with a reverse flow circulation of carrier medium to remove aggregate remaining in the completion string above the crossover point. Such reverse flow is a carrier medium flow that descends along the carrier annulus to the cross-over point and up the completion string bore to the surface. Throughout each of the flow circulation reversals, it is necessary that a net positive pressure be maintained against the producing zone of the wellbore to prevent any borewall collapse. To this objective, a crossover tool 50 as illustrated by FIG. 2 is constructed to operatively combine with the gravel pack body 20.

Generally, the crossover tool 50 assembles coaxially with the gravel pack body 20 and includes a setting tool 52 that is attached to the lower end of the completion string 46. The setting tool 52 comprises a collar 54 having a lower rim face that mates with the tool shoulder 32 of the gravel pack body 20 when the crossover tool 50 is structurally unitized by a mutual thread engagement 55 with the gravel pack body 20. Transverse apertures 56 perforate the collar 54 perimeter.

Internally of the collar 54 rim, an inner tube 60 is structurally secured therewith. As best seen from the detail of FIGS. 5 and 6, a thread collar 62 surrounds the upper end of the inner tube 60 to provide an upper void chamber 64 between the thread collar 62 and the tube 60. The thread collar 62 is perforated for fluid pressure transmission between the collar apertures 56 and the void chamber 64. Fluid pressure transmission channels are also provided between the void chamber 64 and an upper by-pass chamber 66. The upper by-pass chamber 66 is an annular void space between the inner tube 60 and an outer lip tube 68. Axially, the upper by-pass chamber 66 is terminated by a ring-wall 70. An upper by-pass flow channel 72 opens the chamber 66 to the outer volume surrounding the outer lip tube 68. An upper o-ring 74 seals the annular space between the outer lip tube 68 and the inner sealing surface 26 of the packer 22. The outer perimeter of the ring-wall 70 carries o-ring 76 for the same purpose when the crossover tool 50 is axially aligned with the sealing surface 26.

A lower sleeve 80 coaxially surrounds the inner tube 60 below the ring-wall to create a lower by-pass chamber 82. A lower by-pass flow channel 84 opens the chamber 82 to the outer volume surrounding the lower sleeve 80. O-ring 86 cooperates with the packer sealing surface 26 and the o-ring 76 to selectively seal the lower by-pass flow channel 84.

At the lower end of the inner tube 60, a check valve ball seat 90 is provided on an axially translating sleeve 91. The seat 90 is oriented to selectively obstruct downward fluid flow within the inner tube 60. Upward flow within the tube is relatively unobstructed since a cooperative check valve ball 92 is uncaged. Upward fluid flow carries the check valve ball away from the seat 90 and upward along the tool string 46 bore. Above the check valve seat 90 is a crossover port 94 between the bore of the inner tube 60 and the outer volume surrounding the lower sleeve 80. O-rings 96 and 98 cooperate with the lower seal bore 102 of the lower seal ring 100 to isolate the crossover port 94 when the crossover tool is correspondingly aligned. Below the check valve seat 90 are by-pass flow channels 99 in the sleeve 91 and flow channels 88 in the inner tube 60. When aligned by axial translation of the sleeve 91, the flow channels 88 and 99 open a fluid pressure communication channel between the lower by-pass chamber 82 and the internal bore of the lower sleeve 80 below the valve seat 90. Alignment translation of the sleeve 91 occurs as a consequence of the hydraulic pressure head on the sleeve 91 when the ball 92 is seated. By-pass flow channels 29 are also provided through the wall of gravel pack extension tube 23 between the inside sealing surfaces 26 and 28 of the packer body 20.

Below the lower sleeve 80 but structurally continuous with the crossover tool assembly are an anti-swabbing tool 110 and an axial indexing collet 150. The purpose of the anti-swabbing tool is to control well fluid loss into the formation after the gravel packing procedure has been initiated but not yet complete. The axial indexing collet 140 is a mechanism that is manipulated from the surface by selective up or down force on the completion string that positive locate the several relative axial positions of the crossover tool 50 to the gravel pack body 20.

Figure 3:
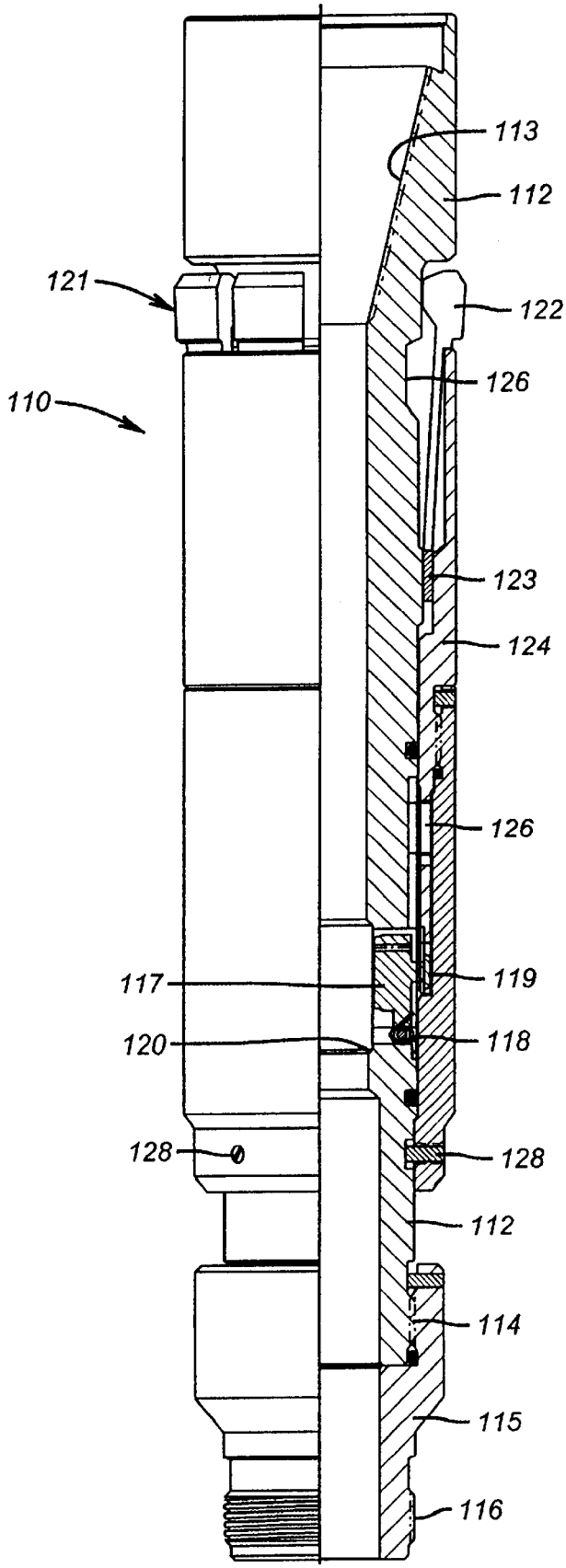
FIG. 3 is a partially sectioned elevation of an anti-swabbing tool having combination utility with the present invention.

In reference to FIG. 3, the anti-swabbing tool 110 comprises a mandrel 112 having internal box threads 113 for upper assembly with the lower sleeve 80. The mandrel 112 is structurally continuous to the lower assembly thread 114. At the lower end of the mandrel 112, it is assembled with a bottom sub 115 having external pin threads 116. Within the mandrel 112 wall is a retaining recess for a pivoting check valve flapper 117. The flapper 117 is biased by a spring 118 to the down/closed position upon an internal valve seat 120. However, the flapper is normally held in the open position by a retainer button 119. The retainer button is confined behind a selectively sliding key slot 126 that is secured to a sliding housing sleeve 124. The housing sleeve 124 normally held at the open position by shear screws 128. At the upper end of the housing sleeve 124 is an operating collet 121 having profile engagement shoulders 122 and an abutment base 123. A selected up-stroke of the completion string causes the collet shoulders 122 to engage an internal profile of the completion string. Continued up-stroke force presses the collet abutment base 123 against an abutment shoulder on the housing sleeve. This force on the housing sleeve shears the screws 128 thereby permitting the housing sleeve 124 and key slot 126 to slide downward and release the flapper 117. The downward displacement of the housing sleeve also permits the collet 121 and collet shoulders 122 to be displaced along the mandrel 112 until the profile of the collet shoulders 122 fall into the mandrel recess 126. When retracted into the recess 126, the shoulder 122 perimeter is sufficiently reduced to pass the internal activation profile thereby allowing the device to be withdrawn from the well after the flapper has been released.

Coaxial alignment of the crossover tool 50 with the gravel pack body 20 is largely facilitated by the axial indexing collet 140 shown by FIGS. 4A–4E. The collet 140 is normally secured to the lower end of the crossover tool 50 and below the anti-swabbing tool 110. With respect to FIG. 4, a structurally continuous mandrel 142 includes exterior surface profiles 146 and 148. The profile 146 is a cylinder cam follower pin. The profile 148 is a collet finger blocking shoulder. Both profiles 146 and 148 are radial projections from the cylindrical outer surface of the mandrel 142. Confined between two collars 152 and 154 is a sleeve collet 144 and a coiled compression spring 150. The bias of spring 150 is to urge the collet sleeve downward against the collar 154.

Characteristic of the collet 144 is a plurality of collet fingers 147 around the collet perimeter. The fingers 147 are integral with the collet sleeve annulus at opposite finger ends but are laterally separated by axially extending slots between the finger ends. Consequently, each finger 147 has a small degree of radial flexure between the finger ends. About midway between the finger ends, each finger is radially profiled, internally and externally, to provide an internal bore enlargement 149 and an external shoulder 148. The outside diameter of the collet shoulder section 148 is dimensionally coordinated to the inside diameter of the indexing profiles 36, 37 and 38 to permit axial passage of the collet shoulder 148 past an indexing profile only if the fingers are permitted to flex radially inward. The internal bore enlargement 149 is dimensionally coordinated to the mandrel profile projection 148 to permit the radial inward flexure necessary for axial passage. The outside diameter of the mandrel projection 148 is also coordinated to the inside diameter of the collet fingers 147 so as to support the fingers 147 against radial flexure when the mandrel projections 148 are axially displaced from radial alignment with the finger enlargements 149. Hence, if the mandrel projection section 148 is not in radial alignment with the collet finger enlargement section 149, the collet sleeve will not pass any of the axial indexing profiles 36, 37 and 38 of the gravel pack body extension tube 23.

The internal bore of the collet sleeve 144 is formed with a female cylinder cam profile to receive the cam follower pin 146 whereby relative axial stroking between the collet sleeve 144 and the mandrel 142 rotates the sleeve about the longitudinal axis of the sleeve by a predetermined number of angular degrees. The cam profile provides two axial set positions for the collet sleeve relative to the mandrel 142. At a first set position, the mandrel blocking profile 148 aligns with the internal bore enlargement area 149 of the fingers. At the second set position, the mandrel blocking profile 148 aligns with the smaller inside diameter of the collet fingers 144. The mechanism is essentially the same as that utilized for retracting point writing instruments: a first stroke against a spring bias extends the writing point and a second, successive, stroke against the spring retracts the writing point.

Operating Sequence

Figures 4A, 4B, 4C, 4D, 4E:
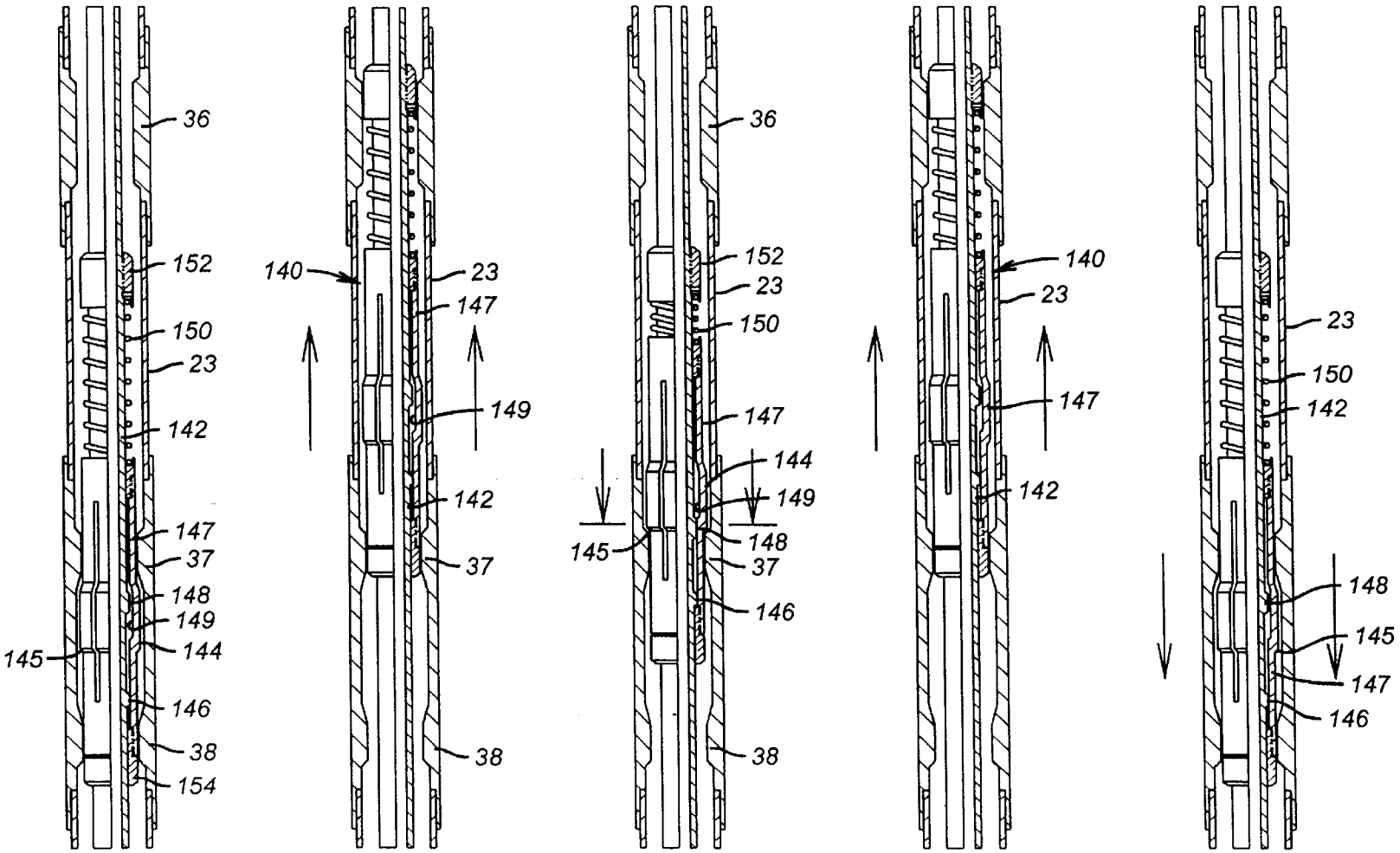
FIGS. 4A–4E schematically illustrate the operational sequence of the indexing collet.
Figure 5:
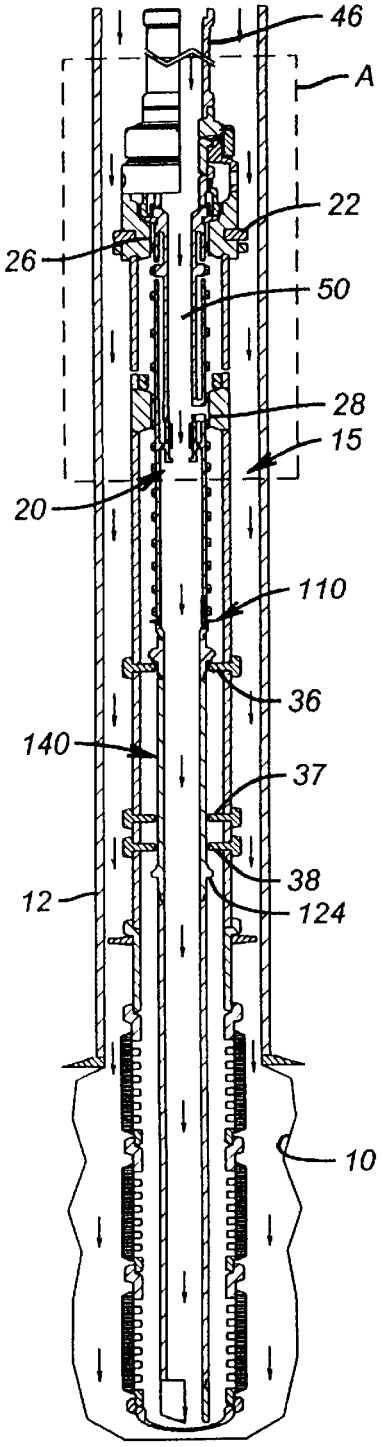
FIG. 5 is a sectional elevation of the gravel pack extension and the crossover tool in coaxial assembly for downhole positionment.
Figure 6:
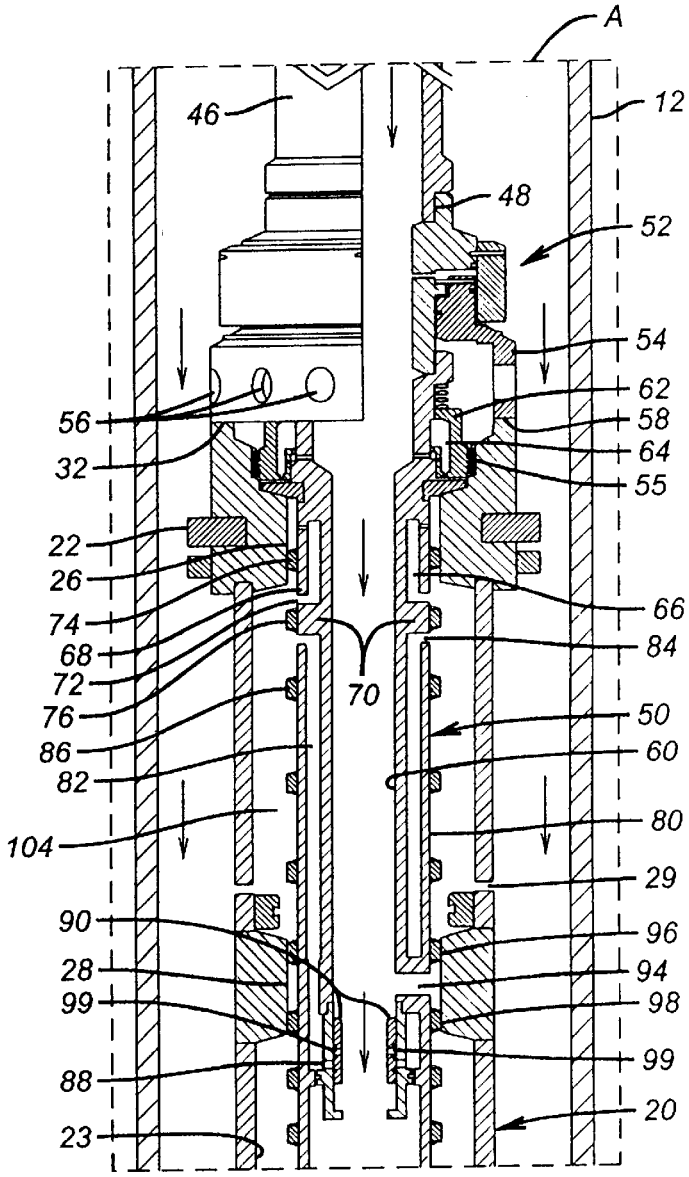
FIG. 6 is an enlargement of that portion of FIG. 5 within the detail boundary A.

Referring to FIGS. 5 and 6, in preparation for downhole positionment within a desired production zone, the gravel pack body 20 is attached to the crossover tool 50 by a threaded connection 55 for a gravel pack assembly 15. A threaded connection 48 also secures the gravel pack assembly 15 to the downhole end of the completion string 46. At this point, the packer seal 22 is radially collapsed thereby permitting the assembly 15 to pass axially along the bore of casing 12. The indexing collet 140 is set in the expanded alignment of FIG. 4A to align the mandrel profile 148 with the finger bore enlargement area 149. Consequently, the collet finger support shoulders 145 will constrict to pass through the tube 23 restriction profiles 36, 37 and 38.

Normally, the casing bore 12 and open borehole 10 below the casing 12 will be filled with drilling fluid, for example, which maintains a hydrostatic pressure head on the walls of the production zone. The hydrostatic pressure head is proportional to the zone depth and density of the drilling fluid. The drilling fluid is formulated to provide a hydrostatic pressure head in the open borehole that is greater than the natural, in situ, hydrostatic pressure of the formation. Since the packer seal is collapsed, this well fluid will flow past the packer 22 as the completion string is lowered into the well thereby maintaining the hydrostatic pressure head on the borehole wall. Consequently, placement of the assembly will have no pressure effect on the production zone. If desired, well fluid may be pumped down through the internal bore of the completion string 46 and back up the annulus around the assembly 15 and completion string in the traditional circulation pattern.

Figure 7:
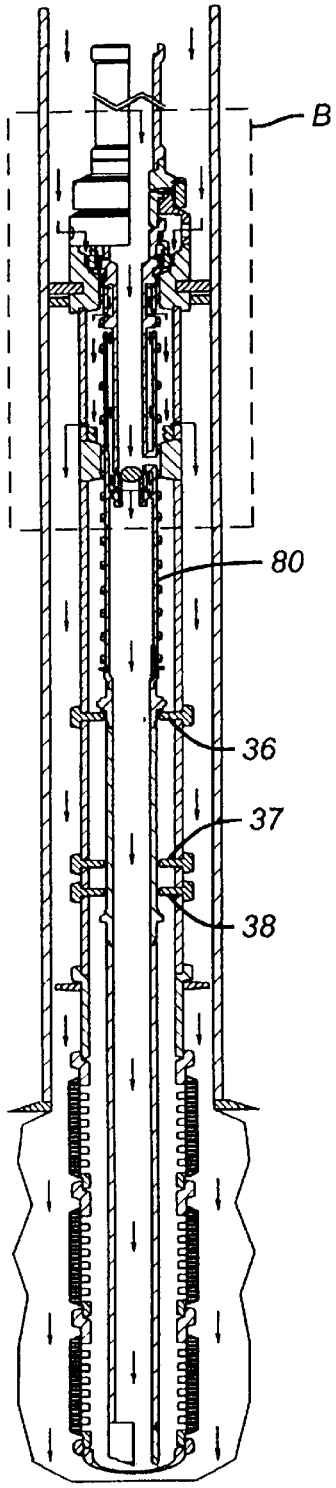
FIG. 7 is a sectional elevation of the gravel pack extension and the crossover tool in coaxial assembly suitable for setting the upper packer.
Figure 8:
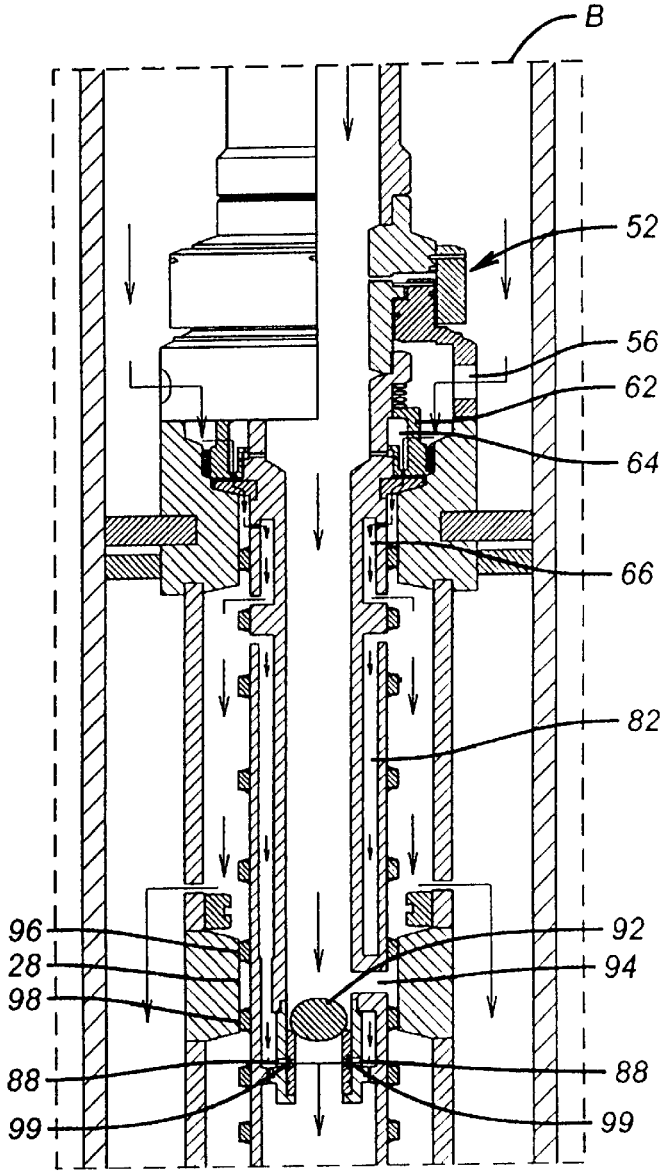
FIG. 8 is an enlargement of that portion of FIG. 7 within the detail boundary B.

When the completion string screens 16 are suitably positioned at the first index position along the borehole length, the check valve ball 92 is placed in the surface pump discharge conduit for pumped delivery along the completion string bore onto the check valve seat 90 as illustrated by FIGS. 7 and 8. Closure of the valve seat 90 permits pressure to be raised within the internal bore 46 of the completion string to secure the completion string location by setting the packer slips and seals 22. When the packer seals 22 are expanded against the internal bore of casing 12, fluid flow and pressure continuity along the casing annulus is interrupted. It is to be noted that the bypass port 94 of the crossover tool is located opposite from the lower seal bore 102 between the o-ring seals 96 and 98, thereby effectively closing the by-pass port 94. However, the restricted by-pass flow routes provided by the collar apertures 56, the void chamber 64, the upper by-pass chamber 66, and the upper by-pass flow channels 72 and 29 prevent pressure isolation of the production zone bore wall 10.

Next, the crossover tool 50, which is directly attached to the completion string 46, may be axially released from the gravel pack body 20 and positioned independently by manipulations of the completion string 46. The completion string 46 is first rotated to disengage the crossover tool threads 55 from the threads 30 of the gravel pack body 20. With the assembly threads 30 and 55 disengaged, the crossover tool 50 is lifted to a second index position relative to the gravel pack body 20. With respect to FIG. 4B, the completion string is lifted to draw the collet fingers 147 through a tube restriction profile. The draw load is indicated to the driller as well as the load reduction when the collet fingers clear the restriction. Additionally, the draw load on the collet sleeve strokes and rotates the sleeve to reset the follower pin in the sleeve cam profile. Accordingly, when the driller reverses and lowers the completion string, mandrel blocking profile 148 aligns with the smaller inside diameter of the collet fingers 147. The external finger shoulders 145 engage the tube profile to prevent further downhole movement of the completion string and positively locate the crossover tool 50 relative to the gravel pack body 20 at a second axial index position as shown by FIG. 4C.

Figure 9:
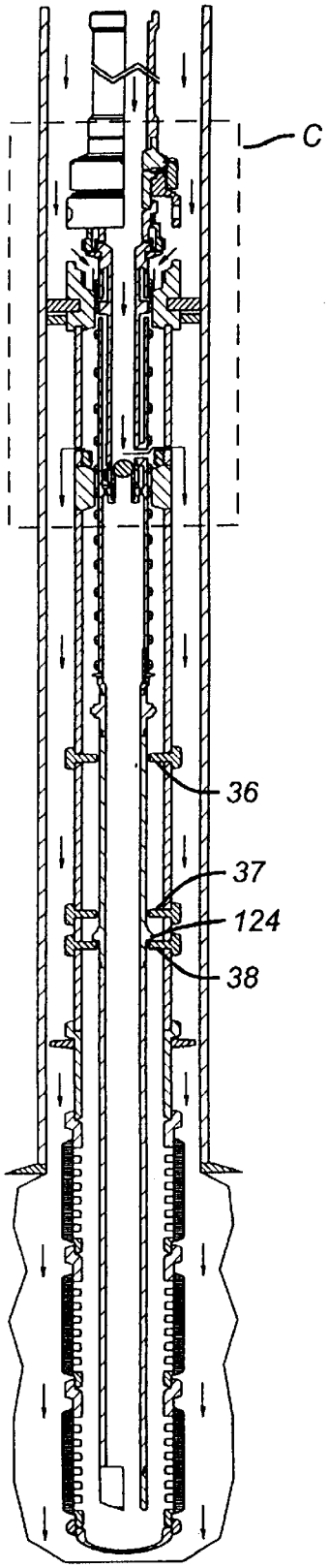
FIG. 9 is a sectional elevation of the gravel pack extension and the crossover tool in coaxial assembly suitable for testing the hydrostatic seal pressure of the upper packer.
Figure 10:
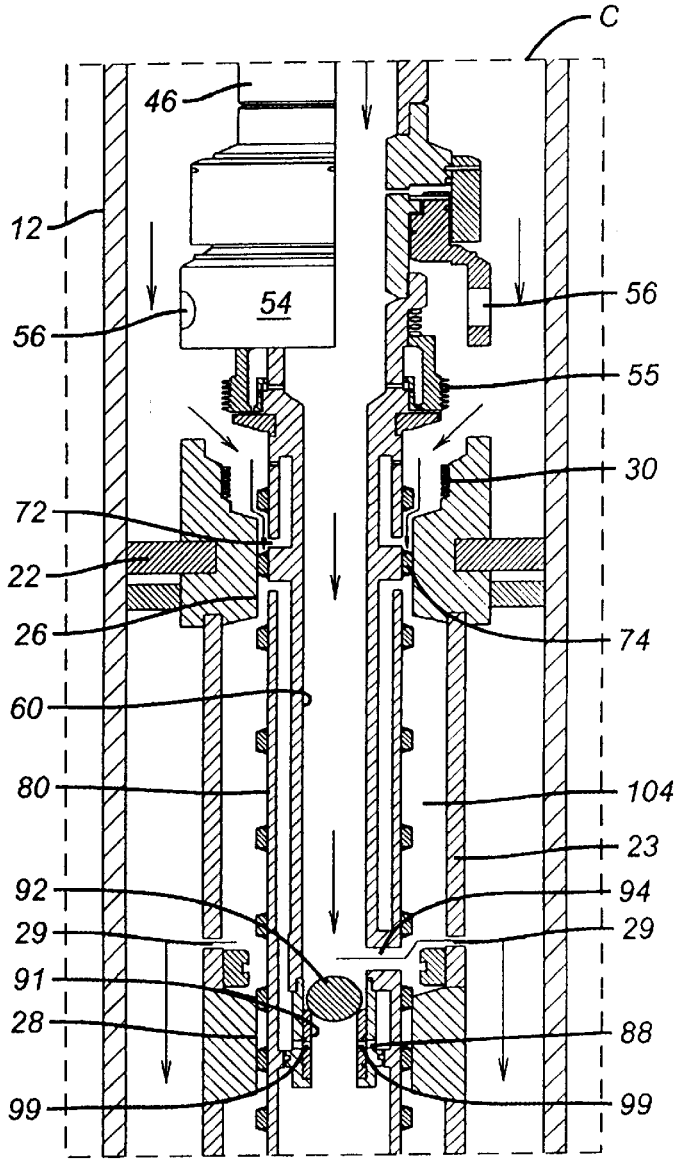
FIG. 10 is an enlargement of that portion of FIG. 9 within the detail boundary C.

With respect to the upper end of the crossover tool assembly 50 as illustrated by FIGS. 9 and 10, the ring-wall o-ring seal 74 engages the sealing surface of the packer 22 to seal the annulus 104 between the gravel pack extension tube 23 and the crossover tool sleeve 80 from by-pass discharges past the packer 22. Simultaneously, the crossover flow port 94 from the internal bore of the inner tube 60 is opened into the annular volume 104 and ultimately, into the casing annulus below the packer 22. Here, the seal integrity of packer 22 may be verified by elevating fluid pressure within the borehole annulus above the packer 22 to a suitable pressure magnitude that is greater than the natural, hydrostatic formation pressure and also greater than the pressure below the packer 22. Simultaneously, wellbore annulus pressure below the packer 22 is also maintained above the natural hydrostatic formation pressure via fluid delivered from surface pumps, for example, along the internal bore of the completion string 46, into the internal bore of the inner tube 60 to exit through the port 94 into annulus 104 between the crossover tool sleeve 80 and the gravel pack extension tube 23. From the annulus 104, pressurized working fluid exits through the by-pass channels 29 into the casing annulus below the packer 22.

Figure 11:
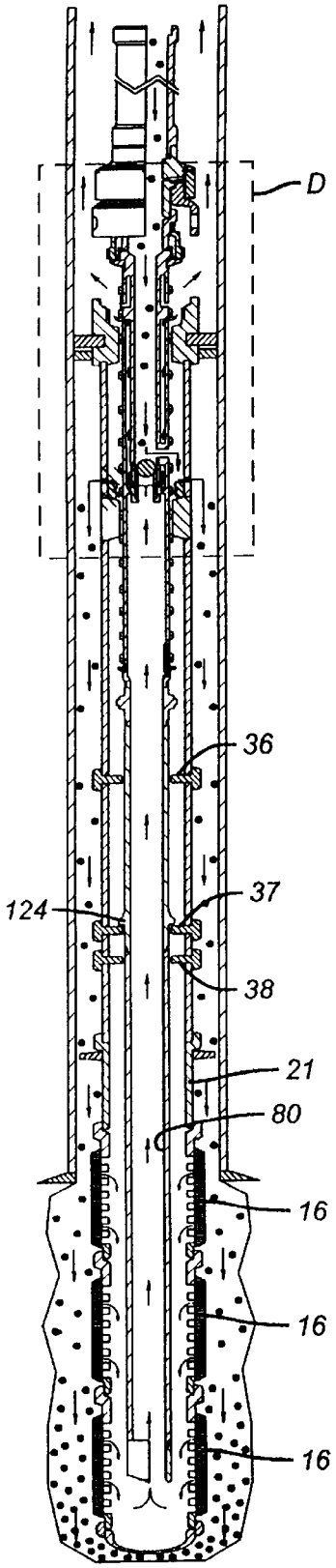
FIG. 11 is a sectional elevation of the gravel pack extension and the crossover tool in coaxial assembly suitable for circulating a gravel packing slurry into the desired production zone.
Figure 12:
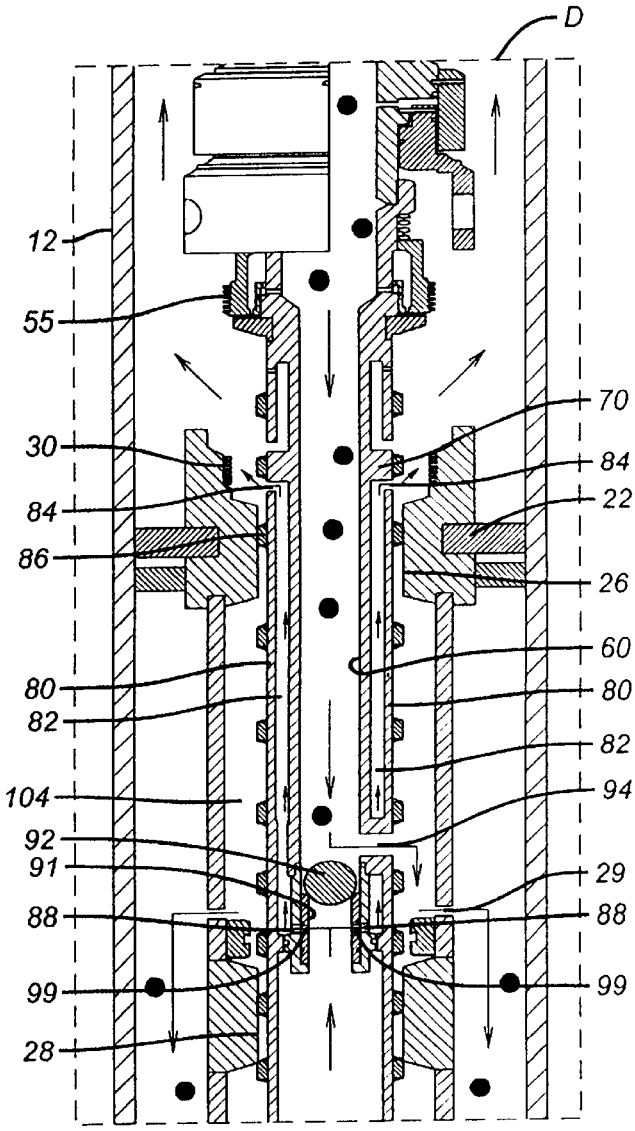
FIG. 12 is an enlargement of that portion of FIG. 11 within the detail boundary D.

With a confirmation of the seal and fixture of packer 22, the crossover tool is axially indexed a third time to the relationship of FIGS. 11 and 12 whereat the ring wall 70 and the lower by-pass flow channel 84 from the lower by-pass chamber 82 are positioned above the sealing surface 26. However, the o-ring seal 86 continues to seal the space between the sealing surface 26 and the lower sleeve 80. At this setting, a fluidized gravel slurry comprising aggregate and a fluid carrier medium may be pumped down the completion string 46 bore into crossover flow ports 94 above the check valve 90. From the crossover flow ports 94, the gravel slurry enters the annular chamber 104 and further, passes through the by-pass channels 29 into the casing annulus below the packer 22.

From the by-pass channels 29, the slurry flow continues along the casing annulus into the open borehole annulus within the production zone 18. Fluid carrier medium passes through the mesh of screen elements 16 which block passage of the slurry aggregate constituency. Accordingly, the aggregate accumulates around the screen elements 16 and, ultimately, the entire volume between the raw wall of the open bore 10 and the screens 16.

Upon passing the screens 16, carrier medium enters the gravel pack extension flow pipe 21 and the internal bore of lower sleeve 80. Below the check valve 90, the carrier medium enters the lower by-pass chamber 82 through the check valve by-pass flow channels 88. At the upper end of the by-pass chamber 82, the carrier medium flow is channeled through the lower by-pass 84 into the casing annulus above the packer 22. The upper casing annulus conducts the carrier medium flow back to the surface to be recycled with another slurry load of aggregate.

Figure 13:
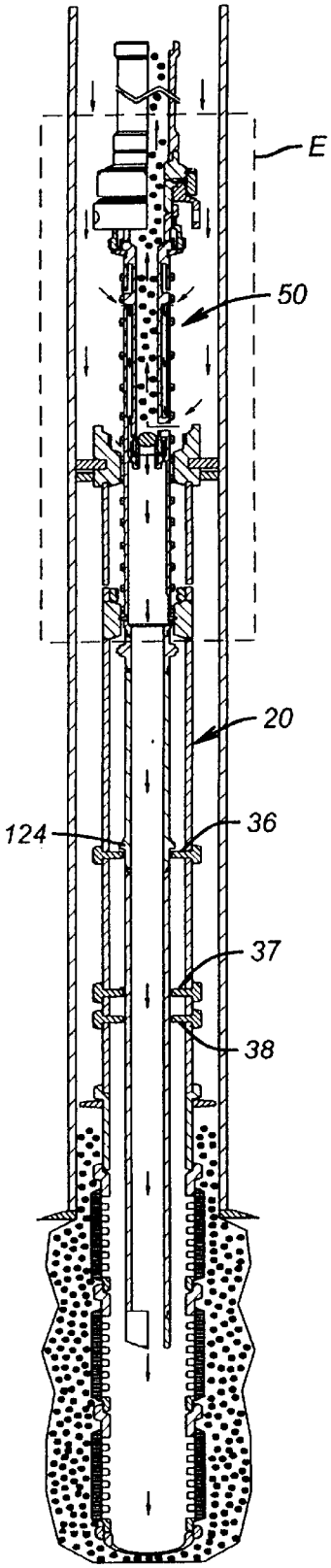
FIG. 13 is a sectional elevation of the gravel pack extension and the crossover tool in coaxial assembly suitable for a flush circulation of the setting tool pipe string.
Figure 14:
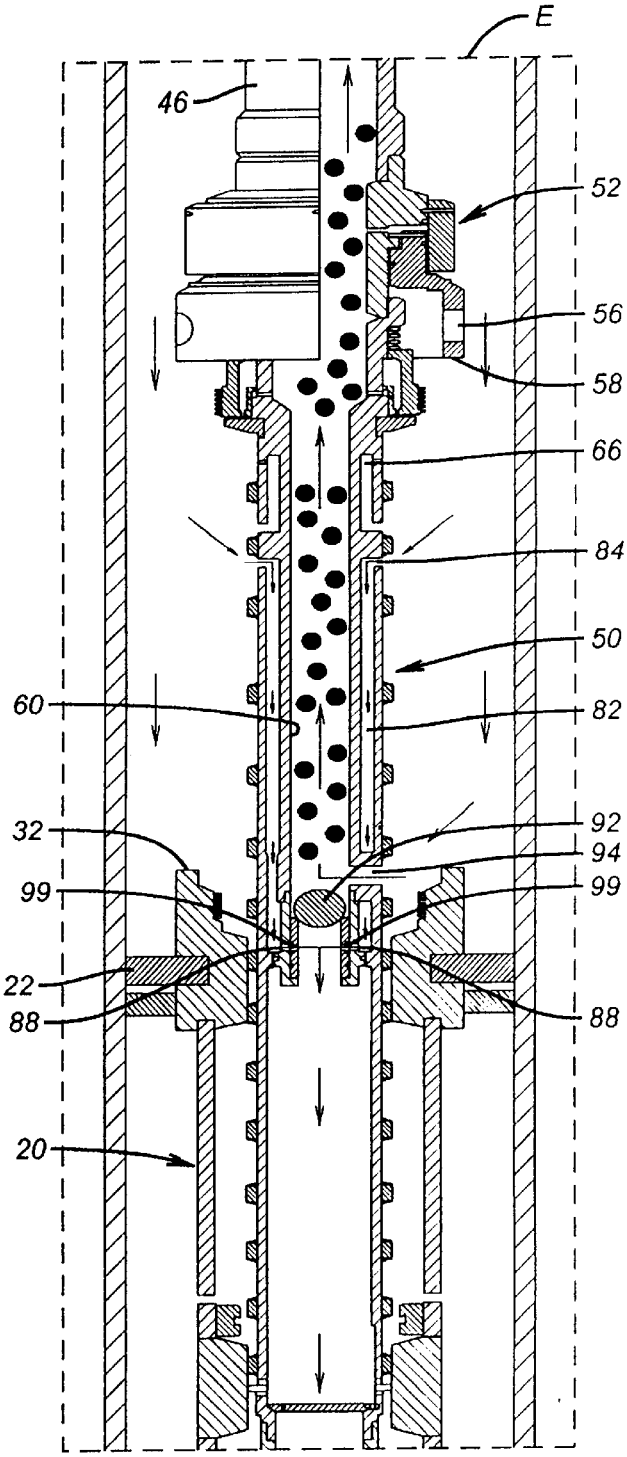
FIG. 14 is an enlargement of that portion of FIG. 13 within the detail boundary E.

Unless it is possible predetermine the exact volume of aggregate necessary to fill the open hole annulus within the production zone 18, excess aggregate will frequently remain in the completion string bore when the gravel pack 24 is complete. Usually, it is desirable to flush any excess aggregate in the completion string bore from the completion string before withdrawing the completion string and attached crossover tool. With reference to FIGS. 13 and 14, the crossover tool 50 is withdrawn from the gravel pack extension 20 to a fourth index position at which the crossover port is open directly to the casing annulus above the upper packer 22. Unslurried well fluid is pumped into the casing annulus in a reverse circulation mode. The reverse circulating fluid enters the inner tube 60 bore above the check valve 90 to fluidize and sweep any aggregate therein to the surface. However, to maintain the desired hydrostatic pressure head on the open hole production zone, reverse circulating well fluid also enters the lower by-pass chamber 82 through the lower by-pass flow channel 84. Fluid is discharged from the chamber 82 through the check valve by-pass flow channels 88 into the volume below the packer 22 thereby reducing any pressure differential across the packer.

With the gravel pack 24 in place, the crossover tool 50 may be completely extracted from the gravel pack body 20 with the completion string and replaced by a terminal sub 44 and production pipe 42, for example.

Utility of the anti-swabbing tool with the crossover assembly 50 arises with the circumstance of unexpected loss of well fluid into the formation after the gravel packing procedure has begun. Typically, a portion of filter cake has sluffed from the borehole wall and must be replaced by an independent mud circulation procedure. As a first repair step, fluid loss from within the completion string bore must be stopped. This action is served by releasing the flapper 117 to plug the bore notwithstanding the presence of the ball plug 92 on the valve seat 90.

The foregoing detailed description of our invention is directed to the preferred embodiments of the invention. Various modifications may appear to those of ordinary skill in the art. It is accordingly intended that all variations within the scope and spirit of the appended claims be embraced by the foregoing disclosure.

What is claimed:

1. The method of conveying a completion string to a desired formation depth within a wellbore, said completion string having a packer, a screen, and a cross-over tool for directing fluid flow into one of at least three flow paths, said method comprising the steps of:

a. setting said packer in said wellbore above said screen, said packer isolating a first well annulus from a second well annulus; and b. maintaining an overburden pressure within said wellbore throughout a well completion process below said packer before, during and after setting said packer.

2. The method of conveying a completion string as described by claim 1 wherein said second well annulus is gravel packed.

3. The method of conveying a completion string as described by claim 1 wherein said cross-over tool directs fluid flow along a first flow path from a fluid flow bore within said completion string into said second well annulus.

4. The method of conveying a completion string as described by claim 3 wherein said cross-over tool directs fluid flow along a second flow path from said fluid flow bore into said first well annulus.

5. The method of conveying a completion string as described by claim 4 wherein said second well annulus is gravel packed along said first flow path.

6. The method of conveying a completion string as described by claim 4 wherein fluid filtrate from said second well annulus gravel packing is returned along said second flow path.

7. The method of conveying a completion string as described by claim 6 wherein fluid filtrate from said second well annulus gravel packing passes through said screen into said second flow path.

8. A method of completing a well into a predetermined earth formation having a natural hydrostatic pressure, comprising the steps of:

a. conveying a tubular completion string along a wellbore into a predetermined formation while continuously maintaining a positive overburden pressure throughout said wellbore, the positive overburden pressure being equal to or greater than the natural hydrostatic pressure, said completion string having an internal flow bore, an annulus packer, a cross-over device and a fluid production screen;

b. setting said packer to separate a first wellbore annulus from a second wellbore annulus with said production screen positioned in said second annulus;

c. the cross-over device being aligned to a first position of fluid communication between said first and second annuli while said packer is being set to separate said first and second annuli; and d. the overburden pressure condition being continuously maintained in both wellbore annuli before, during and after the packer setting procedure.

9. A method of completing a well as described by claim 8 wherein fluid communication between said internal flow bore and either of said annuli is substantially terminated while said packer is being set.

10. A method of completing a well as described by claim 9 wherein said cross-over device is aligned to a second position that substantially terminates fluid communication between said first and second annuli and fluid communication is permitted from said flow bore into said second annulus.

11. A method of completing a well as described by claim 10 wherein fluid pressure is applied to said second annulus from said flow bore of a magnitude that is greater than the natural hydrostatic pressure of a formation penetrated by said second annulus.

12. A method of completing a well as described by claim 11 wherein fluid pressure is externally applied to said first annulus simultaneous with said second annulus pressure, the magnitude of said first annulus pressure being greater than the magnitude of said second annulus pressure.

13. A method of completing a well as described by claim 12 wherein positive pressure within said wellbore is applied to an interface between the wellbore and the formation penetrated by said wellbore.

14. A method of conveying a completion string to a desired formation depth within a wellbore, said completion string having a packer and a screen, said method comprising the steps of:

a. setting said packer in said wellbore above said screen; and b. communicating fluid into the wellbore below the packer to maintain an overburden pressure within said wellbore below said packer before, during and after setting the packer.

15. The method of claim 14 wherein the step of communicating fluid into the wellbore below the packer comprises directing fluid through a bypass flow channel into the annulus below the packer.

16. The method of claim 14 wherein the wellbore below the packer is gravel packed.

* * * * *